United States Patent [19]

Tamás et al.

[11] 4,294,611

[45] Oct. 13, 1981

[54] PROCESS AND APPARATUS FOR REDUCING THE INCLUSION CONTENT OF STEELS AND FOR REFINING THEIR STRUCTURE

[75] Inventors: Istvan Tamás; Lajos Tamas; Gyula Kiss; József Kiss; Antal Kaldor, all of Budapest, Hungary

[73] Assignee: Vasipari Kutató Intézet, Budapest, Hungary

[21] Appl. No.: 81,350

[22] Filed: Oct. 3, 1979

[30] Foreign Application Priority Data

Oct. 4, 1978 [HU] Hungary ..... VA 1535

[51] Int. Cl.[3] ..... C21C 7/10

[52] U.S. Cl. ..... 75/49; 75/58; 75/60

[58] Field of Search ..... 75/60, 49, 53, 58

[56] References Cited

U.S. PATENT DOCUMENTS

| | | | |
|---|---|---|---|
| 3,336,132 | 8/1967 | McCoy | 75/60 |
| 3,467,167 | 9/1969 | Mahin | 75/58 |
| 3,702,243 | 11/1972 | Miltenberger | 75/49 |
| 3,980,469 | 9/1976 | Förster | 75/49 |
| 3,998,625 | 12/1976 | Koros | 75/58 |
| 4,036,635 | 7/1977 | Klapdar | 75/49 |
| 4,054,445 | 10/1977 | Ramacciotti | 75/49 |

FOREIGN PATENT DOCUMENTS

| | | | |
|---|---|---|---|
| 935065 | 8/1963 | United Kingdom | 75/129 |
| 1054885 | 1/1967 | United Kingdom | 75/53 |
| 1100475 | 1/1968 | United Kingdom | 75/129 |
| 1226738 | 3/1971 | United Kingdom | 75/53 |
| 1288336 | 9/1972 | United Kingdom | 75/60 |
| 1291309 | 10/1972 | United Kingdom | 75/49 |
| 1413595 | 11/1975 | United Kingdom | 75/129 |
| 1435189 | 5/1976 | United Kingdom | 75/60 |
| 1494668 | 12/1977 | United Kingdom | 75/53 |

OTHER PUBLICATIONS

Ototani, "Deoxidation and Desulfurization of Liquid Steel with Calcium Alloys," Tetsu-to-Hagené, pp. 334–342 (1971).

Savena, "Effect of Injection of CaO-Containing Slag Powder on Deoxidation Characteristics of Aluminum--Killed Steel, " Scand. J. Met 4.

"Scandinavian Lancers Injection Metallurgy System Eyes Invasion of American Shores", 33 Metal Producing, 4/1978.

*Primary Examiner*—Peter D. Rosenberg

*Attorney, Agent, or Firm*—Karl F. Ross

[57] ABSTRACT

A process for reducing the inclusion content of steels and refining their structure which comprises the steps of subjecting molten steel containing inclusions to a pressure of at least 1 atm; removing inclusions from the molten steel by introducing therein at said pressure an inclusion-removing alloy containing calcium or magnesium; and thereafter applying vacuum to the molten steel to evaporate residual calcium or magnesium from the steel.

2 Claims, 3 Drawing Figures

PROCESS AND APPARATUS FOR REDUCING THE INCLUSION CONTENT OF STEELS AND FOR REFINING THEIR STRUCTURE

FIELD OF THE INVENTION

The invention relates to a process and an apparatus for reducing the inclusion-content of steels and for refining their structure.

BACKGROUND OF THE INVENTION

The inclusions constituting impurities in steels can be of the following composition: oxides, sulfides, phosphides, silicates, aluminates, nitrides, arsenides, etc. or composites of the same compounds, perhaps complex compounds thereof. The inclusions themselves can be exogenous or endogenous. It is well known that the development of endogenous inclusions is initiated by adding an inclusion-removing alloy or by change of solubility.

At the appropriate temperature, primary inclusions can be relatively easily removed from the steel bath by the addition of an inclusion-removing alloy. When the proper inclusion-removing alloy is used, the removal can be almost complete.

Those alloys are suitable for the purpose, which produce insoluble inclusions of lower specific gravity and lower melting point than these of the steel. The processes applied should promote the floating of the inclusion in the metal bath.

Upon casting following the removal of primary inclusions, the metal melt cools down and secondary inclusions appear due to the change of the equilibrium constant. The removal of these secondary inclusions is more complicated than the removal of the primary inclusions and their total removal is practically impossible.

Between the liquidus and solidus lines (i.e. in the liquid+solid two-phase range), it is not possible to remove the tertiary inclusions stuck along the grain boundries due to the segmentation of the inclusions. Furthermore, it is not possible to remove quaternary inclusions segregating at locations energetically above the average places (pores, grain boundaries, dislocations) during the polymorphous transformation due to the reduced solubility. These inclusions remain in the metal at room temperature.

The greatest part of inclusions in a steel are the most injurious oxide inclusions. Their removal or reduction is therefore of great significance. So we deal with these inclusions first. At the same time, however, it should be emphasized that the process may be applied for removing other inclusions as well.

The amount of oxide inclusions in a steel at room temperature depends on the oxygen activity level which can be influenced by deoxidation.

The deoxidation is a very complicated and complex metallurgical process and is influenced by many factors, e.g. deoxidation capability, quantity composition, melting point, extent and speed of solubility, etc. of the deoxidation element. Furthermore, the temperature and oxidation degree of the bath, the amount of other additives, physical and chemical characteristics, growth and removal of the deoxidation products, also play important roles. Among these factors the deoxidation capability of the deoxidant is of major importance from the point of view of the effectivity of deoxidation.

Altough the deoxidation is rather complicated as a metallurgical process, it is carried out even nowadays by simply throwing the deoxidant onto the surface of the metal bath. Only recently have blasting lances and inert gas streams for leading the deoxidant into the metal melt been used.

In special cases the deoxidation is carried out in vacuum in order to avoid the reaction of the deoxidation material and the oxygen of the air.

The Hungarian Pat. No. 174,104 deals with the removal of the primary endogenous inclusions segregating under the influence of the inclusion-removing alloy. Several methods for removing the inclusions from the bath as well as the composition of an inclusion-removing alloy are disclosed.

This inclusion-removing alloy most suitable for removing the inclusions from steels contains 40–50% silicon, 15–30% aluminum, 10–25% calcium, 1.5–15% manganese as well as 2–20% titanium, zirconium, niobium, hafnium, cerium, boron and the rest iron.

The above solution is, however, suitable only for removing the primary inclusions and may not be applied to reduce the quantity of secondary inclusions or to refine the steel structure.

OBJECT OF THE INVENTION

The object of the present invention is to provide an improved process for reducing the secondary inclusion content of steels and for refining the steel structure.

SUMMARY OF THE INVENTION

According to the invention, the inclusions are removed from the steel by inclusion-removing alloys containing calcium and/or magnesium under a pressure equal to or greater than the ambient pressure. Afterwards the bath is subjected to vacuum and the calcium an/or magnesium are evaporated from the steel bath.

It is advantageous to remove the inclusions under a higher pressure, preferably under 2 to 6 atm. The value of the vacuum employed during boiling-out amounts to $10^{-3}$ to 10 torr, in general.

The apparatus according to the invention comprises a closed chamber and a tundish with the steel bath injector means and a lance. The chamber is provided with a vacuum unit. A pressure source is preferably connected to the injector means.

The invention is based upon recognition of the fact that the deoxidation ability of the calcium—and especially of the magnesium—depends on the pressure to a great extent and this can be used by the process and apparatus invented by us for further reducing the inclusion content of steels as well as for refining their structure.

We arrived at the above conclusion by undertaking deoxidation experiments with the alloy given in the above mentioned Hungarian patent. In the course of these experiments, the deoxidation was carried out:

(a) by throwing the deoxidation material onto the steel bath;

(b) by blasting the deoxidant through a lance with inert gas and (c) by employing vacuum.

The experiments proved that the best results can be achieved with a lance and inert gas. This was surprising since the best results should have been expected from the deoxidation in vacuum—in view of the state of art.

Afterwards, deoxidation was carried out using a lance and inert gas and applying a vacuum following this step. In this way, surprisingly good results were achieved. The oxygen and sulphur content of the steel as well as its hydrogen content were lower than ever before. The inclusions contained scarcely any magnesium oxide and calcium oxide, although the deoxidant did contain magnesium and calcium in considerable amounts. It was also surprising that the majority of the inclusions were to be found not on the grain boundaries but inside of the crystal lines. The inclusions were small and the structure of the steel was surprisingly fine.

Further examinations led to the conclusion that the best results can be achieved by carrying out the deoxidation under pressure with an alloy containing magnesium and calcium, with the steel being treated in vacuum afterwards.

BRIEF DESCRIPTION OF THE DRAWING

Further details of the invention will be apparent from the following detailed description thereof, taken together with the accompanying drawing. In the drawing.

SPECIFIC DESCRIPTION

Figure 1:
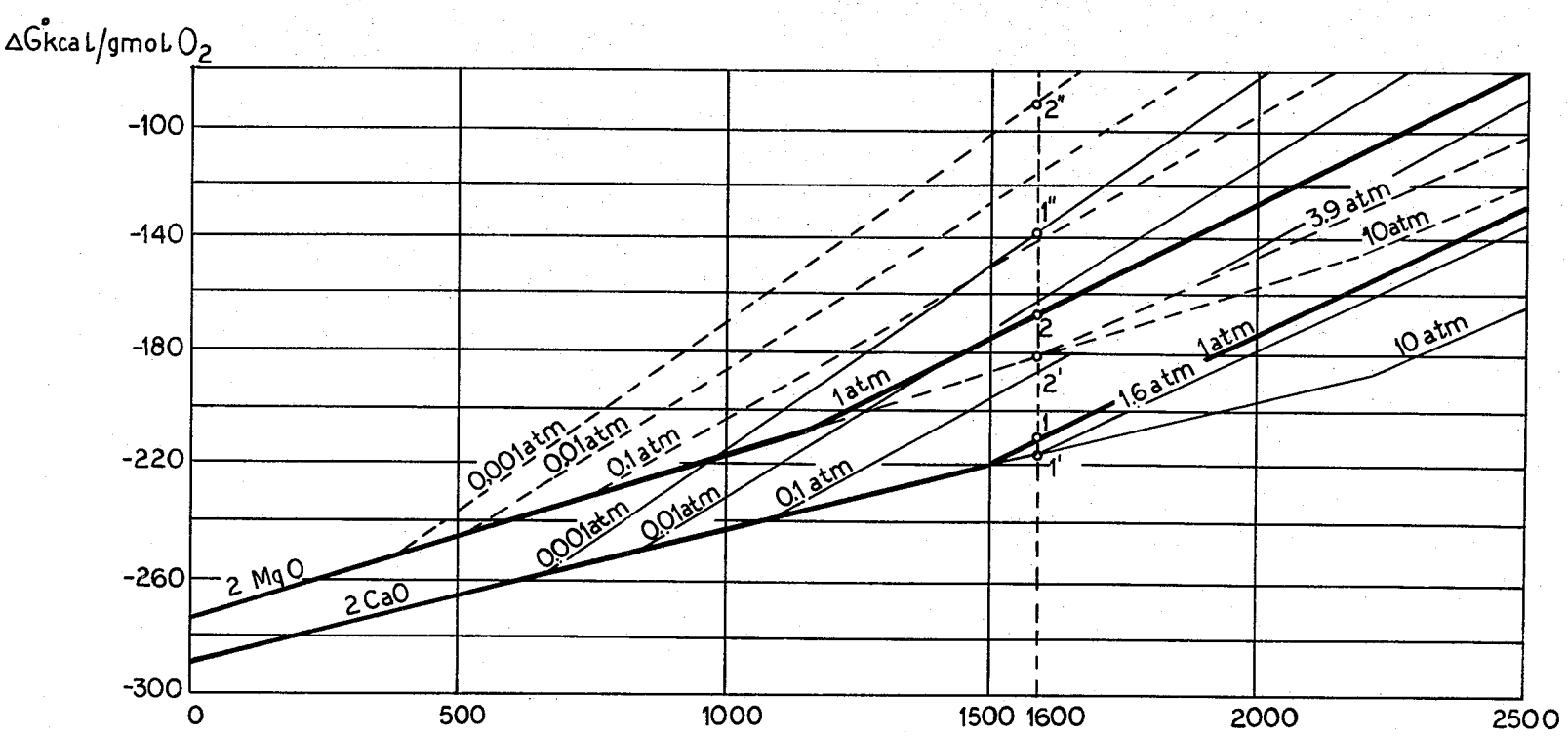
FIG. 1 is a diagram showing the deoxidation behavior of calcium and magnesium.

In order to facilitate an understanding of the present invention, the effect of the pressure change on the deoxidation behavior of calcium and magnesium is shown in FIG. 1.

In the diagram of FIG. 1 the quantity of the thermodynamic standard free energy changes is plotted against the temperature. The thermodynamic standard free energy change may be calculated from the equation:

$$\Delta G^\circ = \Delta H - T\Delta S = -RT\ln K_D.$$

FIG. 1 clearly shows that deoxidation capability of the calcium and magnesium may be increased by raising the pressure. Lowering the pressure or producing vacuum, however, results in a decreasing deoxidation capability.

Point 1 shows the deoxidation ability of the calcium, Point 2 that of the magnesium, if the deoxidation takes place at 1600° C. and p=1 atm pressure. Should the deoxidation be carried out under a pressure higher than 1 atm, the deoxidation power of the calcium grows at 1.6 atm to a value corresponding to Point 1' and that of the magnesium at 3.9 atm reaches the value corresponding to Point 2'. This is also shown numerically by $\Delta G^\circ$ becoming more negative.

FIG. 1 shows also that it makes no sense to raise the pressure over 1.6 atm with calcium and over 3.9 atm with magnesium at 1600° C., because it would not have any effect.

If the temperature of deoxidation is raised, however, the pressure should also be raised accordingly. It is evident that raising of pressure at 1600° C. is more effective with magnesium (three times higher pressure causes a three times greater alteration in the value of $\Delta G^\circ$) than in the case of calcium.

Should the deoxidation be carried out in vacuum, e.g. under a pressure of about 0.001 atm, the deoxidation ability of calcium is reduced to a value corresponding to Point 1'', and of magnesium to Point 2''. This phenomenon is also shown numerically by $\Delta G^\circ$ becoming more positive. Vacuum influences the value of $\Delta G^\circ$ in the same way both with calcium and magnesium.

The essence of the invention is that the steel will be deoxidized under pressure with an alloy containing calcium and/or magnesium. After completing the process of deoxidation, the calcium and/or magnesium will be almost completely evaporated out of the steel by a vacuum treatment.

Figure 2:
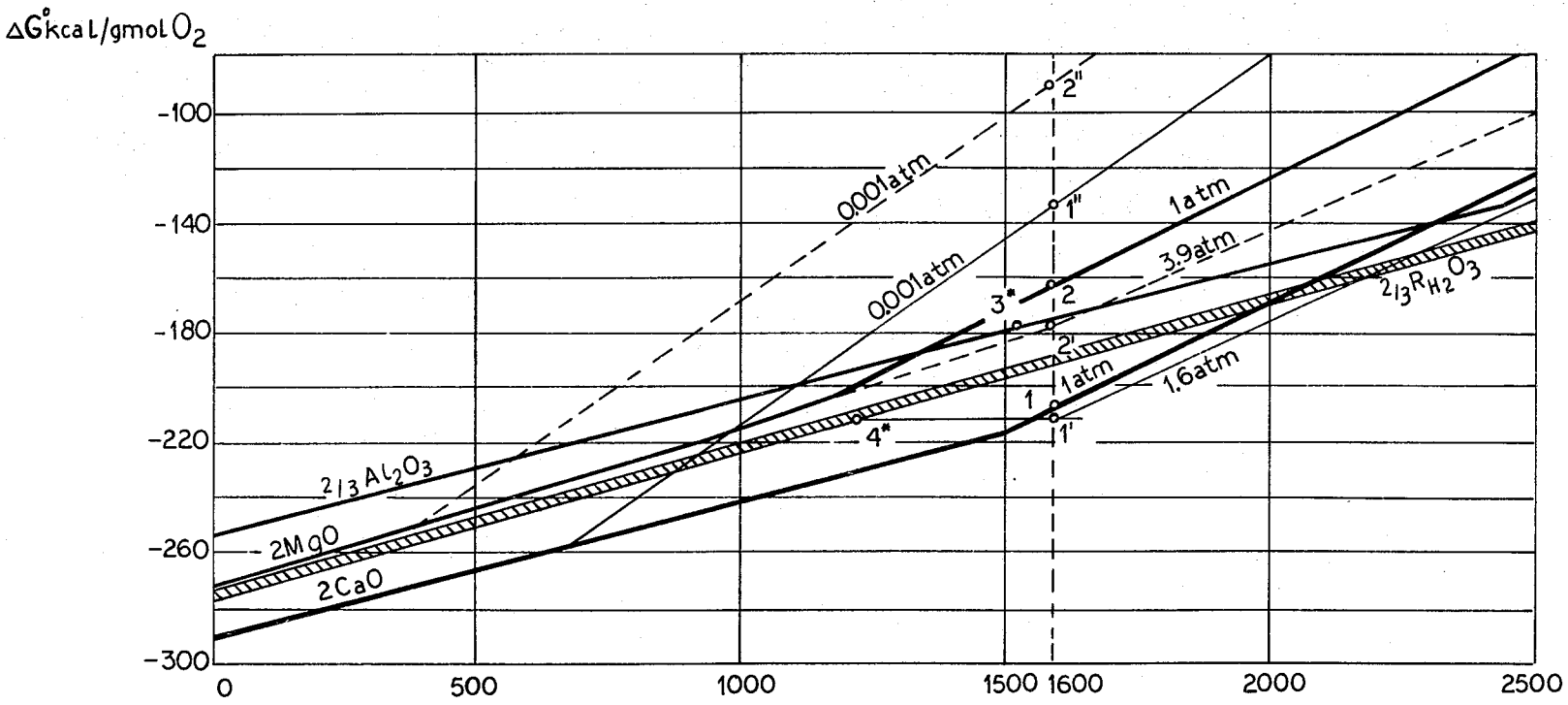
FIG. 2 shows the effect of vacuum treatment following the deoxidation.

The deoxidation characteristics of calcium and magnesium are better if the pressure is raised and worse in vacuum. This is a consequence of the fact that the steel is able to dissolve more calcium and magnesium at the temperature of deoxidation under pressure, whereas calcium and magnesium may be evaporated in vacuum as their boiling point changes due to the pressure change. By increasing the pressure, their boiling point will be raised. In vacuum, however, it is reduced, as shown in FIG. 2 by the displacement of break points (at the same time these are also the boiling points belonging to the given pressure value).

As among the most important deoxidation elements only the calcium (1487° C.) and the magnesium (1102° C.) have lower boiling points than the deoxidation temperature of the steel (1600° C.), an alloy containing calcium and/or magnesium is necessary for realizing the above process.

The inclusion content of the steel treated with this process is lower than that of steel treated with any of the formerly known inclusion-removing processes. None of the prior processes contain the step of applying pressure and thus oxygen levels corresponding to the values of Points 1 and 2 according to FIG. 1 can be reached only. Lower values as given by Point 1', or Point 2', can be reached only by employing the process according to the invention.

However, this is only one of the advantages of said process. The other advantage is shown by FIG. 2.

Point 1'', or 2'' represent the oxygen level in equilibrium with the remaining calcium and/or magnesium content after deoxidation (evaporation of the calcium and/or magnesium, this level being considerably higher than the oxygen level marked by Point 1', or 2' reached in the course of deoxidation. Though the numerical value of the equilibrium constant changes during cooling, secondary inclusions do not segregate until the oxygen level, with respect to one of the deoxidation elements remaining in the steel, reaches the lowest level registered in the course of deoxidation due to the numerical alteration of the equilibrium constant. This point, can easily be located in FIG. 2. If the curves showing the deoxidation features of the deoxidation elements as a function of the temperature are intersected by a straight line representing the lowest oxygen level, the points of intersection mark the temperature at which the above mentioned phenomenon occurs. These points of intersection are $3^x$ and $4^x$. Point $3^x$ corresponds to a deoxidation alloy containing silicon, aluminum and magnesium and point $4^x$ represents an alloy containing silicon, aluminum, calcium, magnesium and earth metals (as e.g. Ce=48-56%, Nd=15-20%, Pr=4-7,%, La=20-25%, other earth metals and impurities<1%). This enables overcooling of the steel and segregation of solid secondary, tertiary and quarternary inclusions. The composition of these inclusions is greatly different from that of the primary inclusions. They contain very small amounts of calcium and/or magnesium or have no Ca and/or Mg content at all. These segregations are present in a great number and in small dimensions and play the role of crystal nuclei, which leads to an extraordinary fine steel structure. Should be not apply a vacuum treatment after deoxidation which means that evaporation of calcium and/or magnesium do not take place, the liquid secondary inclusions rich in calcium oxide and/or magnesium oxide and having almost the same composition as that of the primary ones, would immediately start to segregate in the course of cooling, due to the change of the equilibrium constant. As a consequence, the structure of the steel would not be refined—in absence of overcooling and crystal nuclei. The inclusions would segregate along the grains boundaries and would influence the mechanical characteristics of the steel in a most unfavorable way.

The invention will be illustrated by the following Examples.

EXAMPLE 1

A deep drawable soft steel was made of metal melt consisting of 0.1 to 0.2% carbon, 0.4 to 0.6% manganese, 0.05 to 0.1% silicon, 0.04 to 0.1% aluminum, max. 0.15% phosphorus and max. 0.15% sulfur.

The removal of inclusions (desoxidation, desulfurization, dehydrogenation) was carried out at 1600° C. and a pressure of 4 atm. The inclusion removing alloy contained 45% silicon, 25% aluminum, 4% magnesium and iron. Said inclusion removing alloy was added to the steel bath through a blasting lance with argon. After the removal of inclusions a vacuum of $10^{-2}$ torr was produced. In this way, there remained 70 ppm oxygen and 0.01% sulfur in the alloy. After removal of inclusions from similar alloys, the usual oxygen content amounts to 100 to 200 ppm, the sulfur content to 0.012 to 0.015%. The structure of the steel was extraordinarily fine (average grain diameter: 0.015 measured according to the Hungarian Standard No. 2657). The usual grain diameter of similar alloys is in general 0.028–0.03 mm. The impact energy of the steel treated with the process according to the invention amounts to 16 mkp/mm$^2$ at 20° C. and 6 mkp/mm$^2$ at −40° C. In the case of steels treated with the traditional process, the same values amount to 12–14, resp. 3–5 mkp/mm$^2$. om general.

EXAMPLE 2

Inclusions were removed from a deep-drawable soft steel according to example 1. The inclusion removing alloy was added to the steel bath at 1620° C. and under normal atmospheric pressure. The composition of the inclusion removing alloy was as follows: silicon 50%, aluminum 20%, calcium 20%, magnesium 1.5%, the rest was iron.

After removing the inclusions, a vacuum of $10^{-3}$ torr was produced. After the treatment, the alloy contained 50 ppm oxygen and 0.09% sulfur. The average grain diameter was 0.018 mm. The value of the impact energy amounted to 16 mkp/mm$^2$ and at −40° C. to 6 mkp/mm$^2$.

EXAMPLE 3

Inclusions were removed from the alloy as shown in Example 2 at 1640° C. and a pressure of 4 atm. The composition of the inclusion removing alloy was the following: silicon 40%, aluminum 20%, calcium 15%, magnesium 1.5%, the rest was iron. The blasting was carried out by means of a blasting lance and with argon. The vacuum value after the removal of inclusions amounted to $10^{-1}$ torr. The parameters of the alloy won by means of this method, were as follows: oxygen content: 10 ppm, sulfur content: 0.008%, average grain diameter: 0.008 mm, impact energy at 20° C.: 19 mkp/mm$^2$, at −40° C.: 8 mkp/mm$^2$.

The above Examples clearly show that the secondary inclusion content of the alloys treated by the process according to the invention is reduced to a considerable extent, the steel structure is refined and the mechanical characteristics will be improved, too.

Figure 3:
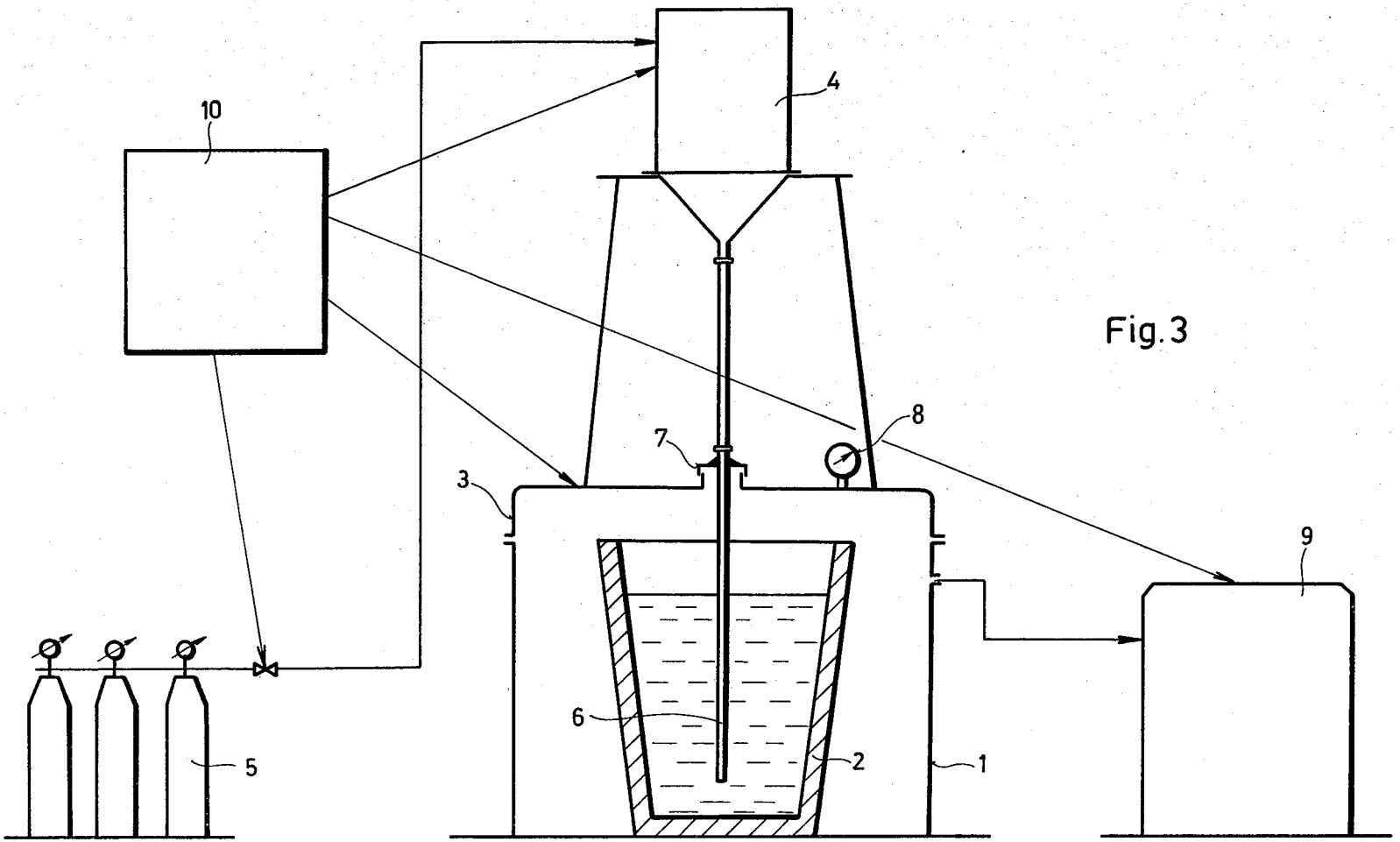
FIG. 3 is a diagram of the apparatus used in the process according to the invention.

FIG. 3 shows the apparatus used for the treatment.

The equipment consists of a chamber 1, in which a vessel 2 comprising the alloy to be treated, is placed. The chamber 1 can be closed by a cover 3. An injector unit 4 is connected to the cover 3. The inclusion removing alloy is located within the injector unit 4. The injector unit 4 is provided with a lance 6 reaching into the metal melt through a stuffing box 7 mounted on the cover 3 of the chamber 1.

The chamber 1 is connected to a vacuum unit 9.

A pressure unit 5 is connected to the injector unit 4. Pressure unit 5 serves for producing the pressure needed for blasting in the inclusion removing alloy on one hand and for enabling to remove the inclusions under pressure on the other hand.

In the case of the embodiment according to FIG. 3, the pressure unit 5 consists of bottles containing inert gas, preferably argon.

The whole equipment can be handled from a control desk 10.

The apparatus may be operated as follows:

In the first step, the vessel 2 filled with pre-oxidized steel is placed into the open chamber 1 by means of a crane.

In the second step, the treatment chamber 1 is closed with cover 3 provided with the injector unit 4.

In the third step, blowing with the help of the pressure unit 5 is started through the injector unit 4. At the same time, lance 6 of the injector unit 4 is sunk into the steel bath deep enough and thus the chamber 1 is sealed by the stuffing box 7 located on the blasting lance 6.

In the fourth step, injector unit 4 is started and the alloy with calcium and/or magnesium content is blown into the steel. The pressure in chamber 1 increases to a value preset by safety valve 8. At this point, the injector unit 4 is stopped.

In the fifth step, the vacuum unit 9 is started and the pressure in chamber 1 will be reduced gradually. Afterwards, the calcium and/or magnesium will be evaporated from the steel.

In the sixth step, the vacuum pump is stopped. Lance 6 of the injecting unit 4 is lifted from the steel bath and the gas flow is stopped too.

In the seventh step the cover 3 is removed from the chamber 1.

In the eighth step the vessel filled with the treated steel is lifted from the open chamber 1 by means of a crane and is transported for casting.

Operating of the different units as well as the control of the whole process is directed from the control desk 10. All the above steps can be carried out in 10–20 minutes.

From the examples may be evident that by using the process according to the invention, the inclusions can be removed from the steels in a most economical way and that the simple equipment according to the invention ensures the realization of the process at low expenses. The inclusion content of the steel produced by means of this method is considerably lower than usual, its structure is extraordinarily fine and its mechanical characteristics are also better than those of the steels the inclusions of which are removed by traditional means.

What we claim is:

1. A process for reducing the inclusion content of steels and refining their structure which comprises the steps of subjecting molten steel containing inclusions to a pressure about 2 to 6 atms; removing inclusions from the molten steel by injecting therein at said pressure through a blast lance by means of an inert gas an inclusion-removing alloy containing calcium or magnesion; and thereafter applying a vacuum of $10^{-3}$ to 10 Torr to the molten steel to evaporate residual calcium or magnesium from the steel.

2. The process defined in claim 1 wherein argon is said inert gas.

* * * * *